US008915982B2

(12) United States Patent
Haefele et al.

(10) Patent No.: US 8,915,982 B2
(45) Date of Patent: Dec. 23, 2014

(54) EXTRACTION APPARATUS WITH GREASE COLLECTION CHANNEL

(71) Applicant: BSH Bosch und Siemens Hausgeräte GmbH, Munich (DE)

(72) Inventors: Matthias Haefele, Gondelsheim (DE); Jochen Klemm, Sandhausen (DE); Ulmar Neumann, Forst (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/974,149

(22) Filed: Aug. 23, 2013

(65) Prior Publication Data

US 2014/0053518 A1 Feb. 27, 2014

(30) Foreign Application Priority Data

Aug. 27, 2012 (DE) ..... 10 2012 215 143

(51) Int. Cl.
*B01D 39/00* (2006.01)
*F24C 15/20* (2006.01)
*E04B 9/02* (2006.01)

(52) U.S. Cl.
CPC ..... *F24C 15/20* (2013.01); *E04B 9/023* (2013.01); *F24C 15/2035* (2013.01); *F24C 15/2042* (2013.01)
USPC ..... 55/357; 55/429; 55/479; 55/515; 55/525; 96/134; 96/154

(58) Field of Classification Search
CPC ..... A47L 9/1427; B01D 46/02; B01D 46/10
USPC ..... 55/357, DIG. 36, 429, 479, 515, 525; 126/299 R, 299 D; 96/134, 154
See application file for complete search history.

(56) References Cited

U.S. PATENT DOCUMENTS

| | | | | |
|---|---|---|---|---|
| 4,099,941 | A | 7/1978 | Gutermuth et al. | |
| 4,266,529 | A | 5/1981 | Gaylord | |
| 5,799,645 | A * | 9/1998 | Strader et al. | 126/39 R |
| 6,182,653 | B1 * | 2/2001 | Otenbaker et al. | 126/299 R |
| 6,468,323 | B1 | 10/2002 | Chwala | |
| 7,041,159 | B2 * | 5/2006 | Entezarian et al. | 96/135 |
| 2004/0261889 | A1 * | 12/2004 | Elgan et al. | 141/10 |
| 2008/0040883 | A1 * | 2/2008 | Beskow et al. | 15/329 |
| 2009/0282641 | A1 * | 11/2009 | Black et al. | 15/352 |
| 2010/0107889 | A1 * | 5/2010 | Denisart et al. | 99/295 |
| 2011/0214565 | A1 * | 9/2011 | Kwok et al. | 95/69 |

FOREIGN PATENT DOCUMENTS

| | | |
|---|---|---|
| NL | 1012019 C2 | 11/2000 |
| WO | 9629549 | 9/1996 |

OTHER PUBLICATIONS

European Search Report EP 13 18 0381 mailed Dec. 18, 2014.

* cited by examiner

*Primary Examiner* — Robert Clemente
*Assistant Examiner* — Karla Hawkins
(74) *Attorney, Agent, or Firm* — James E. Howard; Andre Pallapies

(57) ABSTRACT

An extraction apparatus includes at least one filter and a grease collection channel, wherein the grease collection channel has a number of removable troughs, which support the at least one filter. The troughs can be arranged flush with one another in a holder Each of the troughs has a handle, which has at least one air through-flow opening.

20 Claims, 2 Drawing Sheets

EXTRACTION APPARATUS WITH GREASE COLLECTION CHANNEL

BACKGROUND OF THE INVENTION

The invention relates to an extraction apparatus with a filter and a grease collection channel.

Such an extraction apparatus serves to clean air exiting from a pot or pan for example during a cooking operation. In this process it is also possible in particular to collect grease from the air. The grease flows down the filter and collects in a stationary grease collection channel, into which the filter is also inserted. The grease collection channel can be cleaned after the filter has been removed. If a larger quantity of grease collects in the grease collection channel, the bottom of the filter standing therein can be soiled. Cleaning is then very time-consuming.

BRIEF SUMMARY OF THE INVENTION

It is an object of the present invention to configure an extraction apparatus with a filter and a grease collection channel in such a manner that the grease collection channel can be cleaned in a particularly simple manner with little outlay on the part of the manufacturer and user.

This object is achieved according to the features of the independent claims. Preferred embodiments may be derived in particular from the dependent claims.

The object is achieved by an extraction apparatus with at least one filter and a grease collection channel, the grease collection channel having a number of removable troughs, which support the at least one filter.

This extraction apparatus has the advantage that the troughs (also referred to as grease collection troughs) can be removed and are therefore much easier to clean than a stationary grease collection channel. The troughs can be washed for example in a sink or dishwasher. The troughs can also be replaced easily. The use of a number of (correspondingly short) troughs has the further advantage compared with one (comparatively long) trough that firstly the troughs are easier to clean and secondly the risk of a full trough splashing over is reduced due to safer handling, in particular when the grease level is high. It is also easier to produce a number of small troughs than one large trough, thereby saving production costs. Also small troughs can be used as modular components, being used for example as "standard" modules for extraction apparatuses of different designs and dimensions. Therefore production as a whole is more favorable for manufacturers of extraction apparatuses, as it is not necessary to provide an individually configured grease collection trough of predefined length for every type of extraction apparatus.

The extraction apparatus can be present for example as a standalone kitchen appliance, for example for integration in a worktop, or can be a component or part of a cooking appliance, e.g. a cooking appliance with cooktop and/or a deep-fat fryer.

In one development the troughs are configured from plastic or silicone, allowing them to be produced at particularly low cost. The small spatial extension of a number of smaller or shorter troughs means that they can be produced more simply and at lower cost than one large or long trough, for example a length of 1 m. The production outlay for injection molding for large parts is proportionally much higher. When plastic or silicone is used, small tools and presses can be used to produce the troughs, which impacts favorably on the production price.

In one development the troughs are configured identically, assisting an identical parts principle with simple production and stock organization. However at least two different troughs can also be used.

In one embodiment the troughs each have a handle. The handle considerably simplifies handling for a user, for example during removal, insertion and also washing. The handle also predefines an insertion direction during insertion. The handle can also serve as an anchor, to prevent falling into the extraction apparatus.

The handle can be detachable or can be present as a fixed, integral part of the trough.

In a further embodiment the handle has at least one air throughflow opening. This means that the handle represents almost no obstacle to an air flow, even if it is present in an air extraction duct of the extraction apparatus, with the result that a volume flow of air is not or is not substantially impeded by the at least one filter.

In a further embodiment the troughs can be positioned flush with one another in a holder. Almost all the grease flowing down from the at least one filter can thus be collected by the troughs. Flush, unsealed adjacent positioning is frequently sufficient, as the grease running down is generally not a thin liquid and it is therefore not necessary to seal the space between the troughs. Small quantities of grease flowing into the holder between small gaps in the troughs can be easily cleaned by hand. Such a holder, in particular a channel or track, can be made in particular of metal, thereby ensuring a stable structure. The holder is in particular a component of the extraction apparatus. The holder itself can be removable.

In one alternative embodiment adjacent troughs can be connected with a force and/or form fit and in particular can be released again. This suppresses or prevents a flow of grease between adjacent troughs.

In another embodiment such a filter is supported by or abuts against at least two of the troughs. The extraction apparatus can therefore have one or more filters, which are supported by two or more such troughs respectively.

In a further embodiment at least one of the troughs has a web for supporting or abutting against the filter, the web extending longitudinally within the trough and below the filter. Positioning on a web (in the following also referred to as a longitudinal web) prevents the lower filter frame of the filter standing in the grease in the trough.

In a further embodiment the longitudinal web is a web running continuously between end walls of the trough. This allows the filter to rest continuously on the longitudinal web between the end walls. This prevents a parasitic secondary air flow, which could otherwise flow perpendicular to the web below the filter.

In an alternative development the longitudinal web is formed in a multipart manner from individual, in particular mutually aligned, web elements.

In yet another development the longitudinal web is configured as a central web (running longitudinally in the center of the trough), so that grease running down from the filter, in some instances on both sides, can collect in the trough in an even manner on both sides of the central web. This also suppresses the splashing over of grease, in particular oil, when the trough is full.

In a further embodiment the trough has at least one insertion recess, it being possible to position, in particular insert, the filter in the insertion recess.

In one development the insertion recess can hold the filter, in particular a filter frame of the filter, loosely. The insertion recess can thus serve in particular as a positioning aid when positioning the filter on the troughs.

In an alternative development the insertion opening holds the filter or its filter frame with a force fit or in a clamped manner, thereby securing the filter against tipping. In one combined development provision can be made for a lower segment of the insertion recess to allow the filter to be held with a force fit, while an upper segment of the insertion opening in contrast is widened to serve as an insertion aid.

The insertion recess can be configured for example by means of projections, which project from an inner side wall or base wall of the grease collection channel in the direction of a filter to be inserted or already inserted. In one particular development the insertion recess is configured in a side wall. The insertion recess in a side wall can be formed in particular by a recess in the side wall. Such an insertion recess offers a seal against grease running down the filter in its peripheral region in relation to an adjacent trough or a seal at one end of the grease collection channel formed from a number of troughs. The side wall can refer in particular to a long side wall oriented transversely from the point of view of an air flow, running parallel to or in the longitudinal direction of the configured grease collection channel or an end side wall of the grease collection channel running perpendicular thereto.

The insertion recess can be disposed in particular on an end face of the trough, in particular on an end face on both sides.

In a further embodiment the extraction apparatus has a multipart filter arrangement with at least two adjacently disposed filters, which are supported by troughs disposed in a row. This forms a filter arrangement made up of at least two or even more filters, it being possible to form a single grease collection channel from a plurality of troughs below the overall filter arrangement using simple means.

According to one development at least two filters can be disposed next to one another, in particular to form a wider area next to one another, through which a flow can be established in a direction perpendicular to an air flow to be cleaned. Additionally or alternatively at least two filters can also be disposed behind one another so that the air flow flows through two or more filters one after the other.

In one development a number of troughs can be inserted in a shared holder, e.g. a plastic or metal track.

BRIEF DESCRIPTION OF THE DRAWINGS

The invention is described schematically in more detail in the following figures with the aid of an exemplary embodiment. For reasons of clarity identical elements or those acting in an identical manner can be provided with identical reference characters.

DETAILED DESCRIPTION OF EXEMPLARY EMBODIMENTS OF THE PRESENT INVENTION

Figure 1:
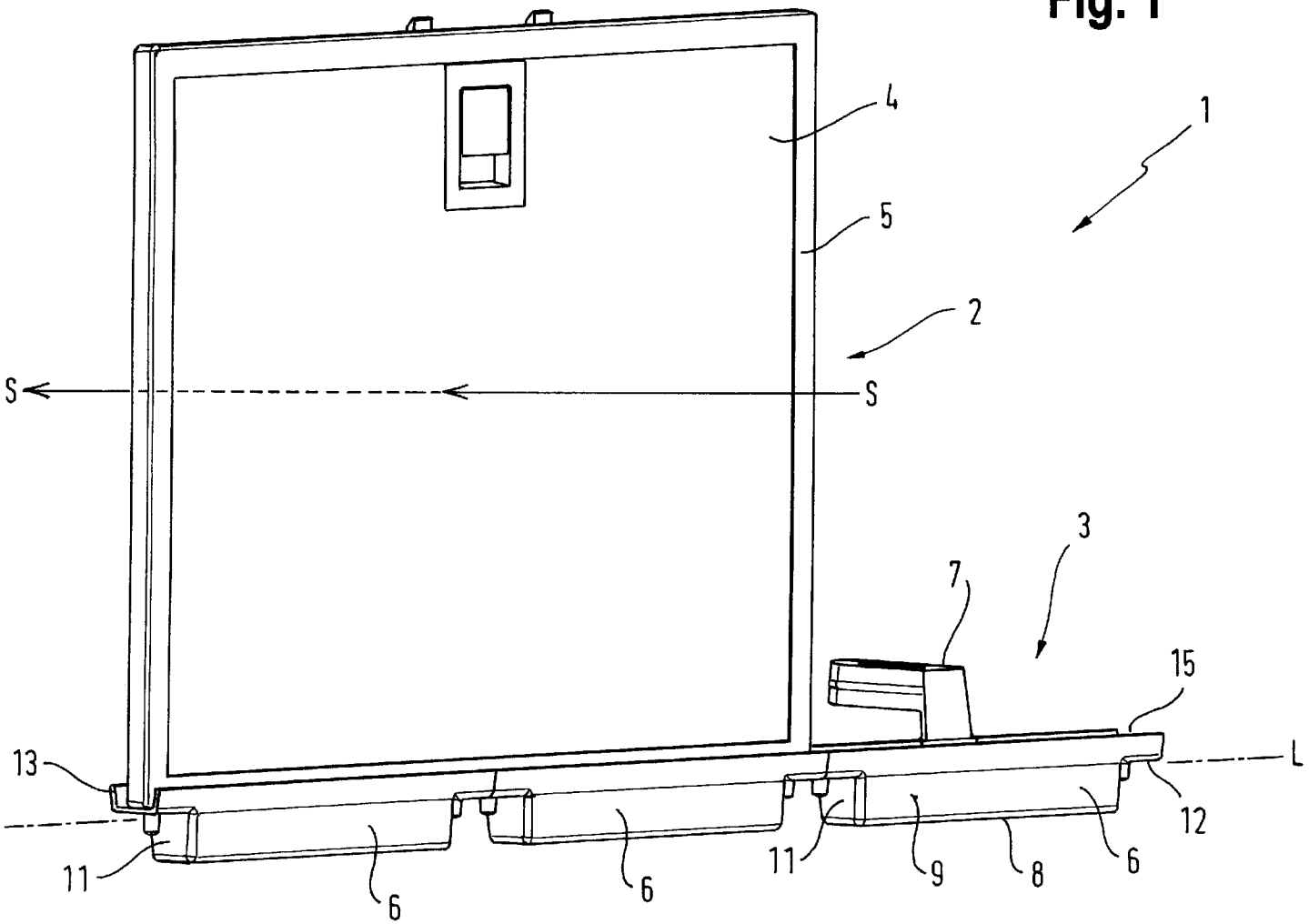
FIG. 1 shows an oblique view of a cutout from an extraction apparatus with at least one filter and with a grease collection channel made up of a number of troughs, which support the filter.

FIG. 1 shows a filter 2 and a grease collection channel 3 as components of an extraction apparatus 1. The filter 2 consists of a filter element 4 and a peripheral filter frame 5 that holds the filter element 4.

The grease collection channel 3 consists of a plurality of individual, identically shaped (grease collection) troughs 6 made of plastic or silicone. The troughs 6 have a rectangular base shape that is open at the top and can be for example injection molded. The troughs 6 are disposed in a row with one another in their longitudinal direction L. In particular the troughs 6 are disposed close together but not fastened to one another. The longitudinal direction L of the troughs 6 runs in particular along a filter frame 5 of the filter 2 and also perpendicular to an air flow S. The air of the air flow S (e.g. steam) flows through the filter 2 and is cleaned, e.g. of grease droplets, in the process.

The illustrated filter 2 is supported upright by two troughs 6. A third grease collection trough 6, which adjoins the two troughs 6, and a further fourth adjoining trough 6 (not shown) serve to support a second filter 2 (not shown). This allows a number of filters 2 to be disposed next to one other, to offer a larger throughflow area for the air flow S.

The grease collection troughs 6 each have a handle 7. The handle 7 projects in a lateral direction from the respective grease collection trough 6.

Figure 2:
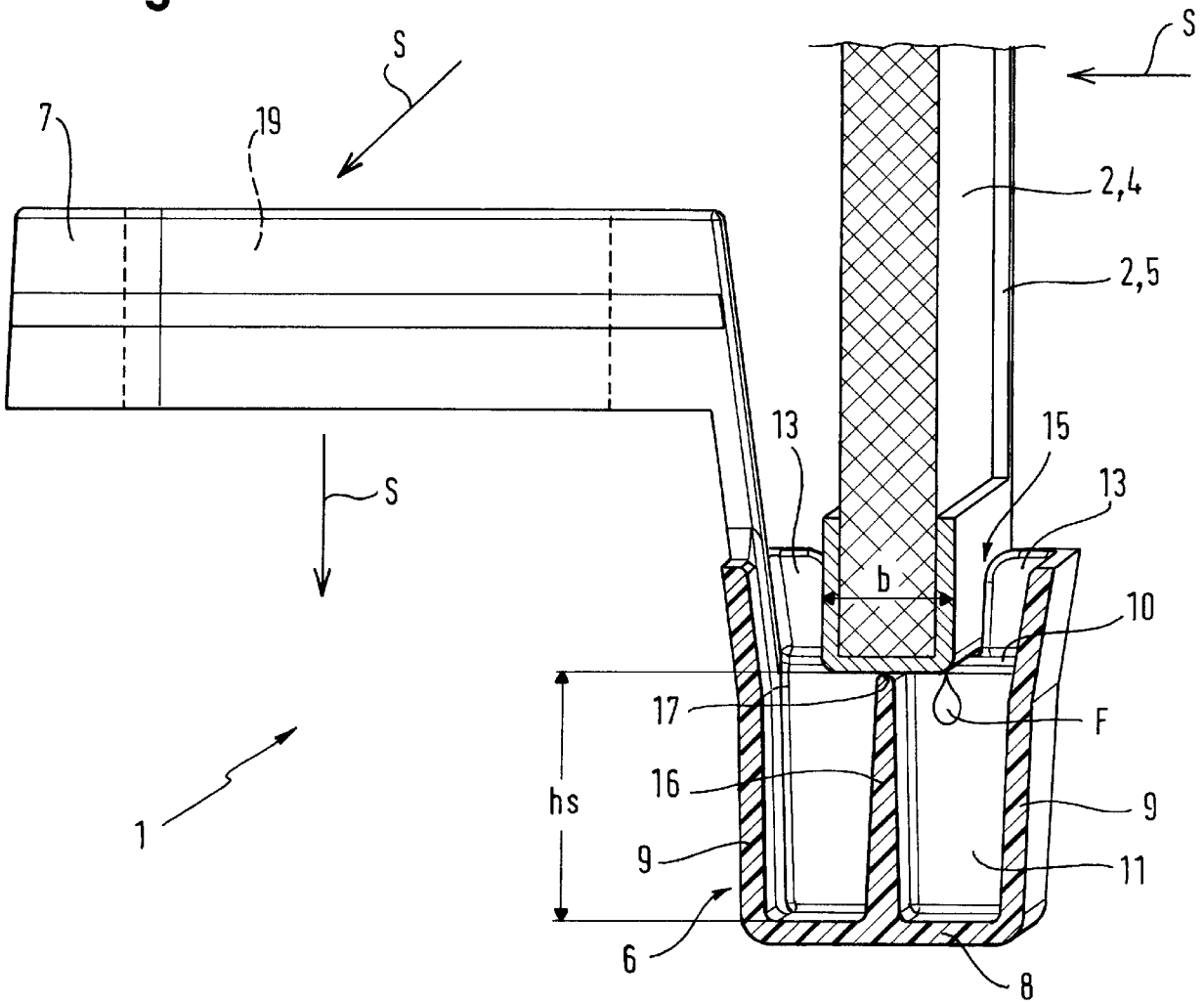
FIG. 2 shows a sectional diagram of an oblique front view of a trough and filter according to FIG. 1.

As shown in FIG. 2, the troughs 6 each have a base 8 and side walls 9 to 11 projecting upward therefrom. Two of the side walls form longitudinal walls 9 embodied with minor symmetry in the longitudinal direction L, which are at a distance from one another and extend in the longitudinal direction of the grease collection trough 6. Two further side walls respectively form transverse walls 11 that run perpendicular thereto or are on end faces.

A transition region 12 extending outward on an end face is present in an upper region of the transverse walls 11. The transition region 12 has a terminating wall 13 on an end face. The terminating wall 13 (which can be seen as part of the transverse wall 11 or an independent wall) has an insertion recess 15 in its center for perpendicular insertion of the filter 2 or its frame 5. A width of the insertion recess 15 preferably corresponds to a width b of the filter frame 5, e.g. for a clamped fit, or is slightly wider than the filter frame 5, e.g. for a looser fit. The filter frame 5 can be positioned on a horizontal transition base 10 connecting the terminating wall 13 to the transverse wall 11 or can rest thereon.

The actual grease collection region 8 to 11 of the trough 6 is located between the transition regions 12 or between the transverse walls 11. Grease F running down from the filter 2 drips over the filter frame 57 into the grease collection region 8 to 11 of the trough 6. Grease F running onto the transition base 10 of the transition region 12 either remains there in small quantities or runs on into the grease collection region 8 to 11 in larger quantities.

At the level of the inserted filter frame 5 the longitudinal walls 9 are at such a large distance from one another and therefore also from the filter frame 5 that the grease F can easily drip down from the filter 2 into the grease collection region 8 to 11. To this end the longitudinal walls 9 are widened slightly in an upper region.

A longitudinal web 16 projects upward from the base 8 to support the filter 2. The filter 2 rests with its filter frame 5 on an upper edge 17 of the longitudinal web 16. The height hs of the longitudinal web 16 extends from the base 8 of the grease collection trough 6 to the height of the transition base 10 upward, allowing straight positioning of the filter 2.

The longitudinal web 16 extends in particular in the center between the longitudinal walls 9, 10 and in the longitudinal direction L of the trough 6 between the transverse walls 11. The filter frame 5 rests in a sealing manner on the longitudinal web 16, in particular in respect of the air flow L, and therefore also on the transition base 10, so that a parasitic air flow through the trough 6 below the filter 2 is avoided or reduced.

The handle 7 extends horizontally from an upper edge of one of the longitudinal walls 9 perpendicular to the longitudinal direction L of the trough 6. In order to impede the air flow S as little as possible, the handle 7 has an air throughflow opening 19.

The troughs 6 are disposed in a holder (not shown). The filter 2 is first removed, in particular lifted out in an upward direction, to take out the troughs 6. The troughs 6 are then gripped at the handle 7 and lifted out of the holder.

The present invention is of course not restricted to the exemplary embodiment shown.

The grease collection troughs 6 can also be made from a material other than plastic, in particular metal.

Intermediate walls can optionally run in a perpendicular manner through the trough 6, serving as stabilizing elements for the trough 6.

What is claimed is:

1. A filtering apparatus for collecting grease from an air flow in a domestic home appliance, the apparatus comprising:

a filter configured to capture the grease from the air flow; and a grease collection channel having a plurality of removable troughs, the channel supporting the filter, wherein the channel is positioned below the filter such that the entire filter is located above the channel and the entire filter is positioned between a first pair of vertical planes that extend vertically from lateral extremities of the channel such that at least a portion of the grease captured by the filter moves under the force of gravity into the channel.

2. An extraction apparatus, comprising:

at least one filter; and a grease collection channel having a number of removable troughs, which support the at least one filter, wherein each of the troughs has a handle.

3. The apparatus of claim 2, wherein the handle has an air throughflow opening.

4. The apparatus of claim 1, further comprising a holder for accommodating the troughs flush with one another.

5. The apparatus of claim 1, wherein the filter abuts against at least two of the troughs.

6. The apparatus of claim 1, wherein at least one of the troughs has a web to abut against the filter.

7. The apparatus of claim 1, wherein each of the troughs has an insertion recess, and the filter rests in the insertion recess.

8. The apparatus of claim 1, further comprising a multipart filter arrangement having two adjacently disposed filters.

9. The apparatus of claim 8, wherein the two adjacently disposed filters are supported by two of the troughs, and the two troughs are arranged longitudinally relative to each other.

10. The apparatus of claim 1, wherein the channel is positioned such that the entire filter is positioned between a second pair of vertical planes that extend vertically from longitudinal extremities of the channel, the second pair of vertical planes being perpendicular to the first pair of vertical planes.

11. A filtering apparatus for collecting grease from an exhaust air stream of a domestic home cooking appliance, the apparatus comprising:

a filter configured to capture the grease from the exhaust air stream;

a first trough having a longitudinal direction and a transverse direction, ends located at extremities of the first trough in its longitudinal direction, sides located at extremities of the first trough in its transverse direction, and a bottom; and a second trough having a longitudinal direction and a transverse direction, ends located at extremities of the second trough in its longitudinal direction, sides located at extremities of the second trough in its transverse direction, and a bottom, wherein the filter rests on the first trough and the second trough, in an operating position, the bottom of the first trough and the bottom of the second trough are positioned below the filter such that the entire filter is located above the bottom of the first trough and the bottom of the second trough, and in the operating position, the entire filter is positioned between a first pair of vertical planes that extend vertically from the sides of the first trough such that at least a portion of the grease captured by the filter moves under the force of gravity into the first trough.

12. The apparatus of claim 11, wherein the first trough has a handle, and the second trough has a handle.

13. The apparatus of claim 12, wherein one of the ends of the first trough abuts one of the ends of the second trough.

14. The apparatus of claim 13, wherein, in the operating position, the ends of the first trough are above the bottom of the first trough, and in the operating position, the ends of the second trough are above the bottom of the second trough.

15. The apparatus of claim 14, wherein the handle of the first trough extends from one of the sides of the first trough, and the handle of the second trough extends from one of the sides of the second trough.

16. The apparatus of claim 15, wherein the handle of the first trough extends in the transverse direction, and the handle of the second trough extends in the transverse direction.

17. The apparatus of claim 12, wherein, in the operating position, the ends of the first trough are above the bottom of the first trough, and in the operating position, the ends of the second trough are above the bottom of the second trough.

18. The apparatus of claim 17, wherein the handle of the first trough extends from one of the sides of the first trough, and the handle of the second trough extends from one of the sides of the second trough.

19. The apparatus of claim 18, wherein the handle of the first trough extends in the transverse direction, and the handle of the second trough extends in the transverse direction.

20. The apparatus of claim 1, wherein each of the troughs has a handle.

* * * * *